United States Patent [19]

Capp et al.

[11] Patent Number: 5,060,372

[45] Date of Patent: Oct. 29, 1991

[54] CONNECTOR ASSEMBLY AND CONTACTS WITH SEVERED WEBS

[76] Inventors: Randolph E. Capp, 424 B Brandy La., Mechanicsburg, Pa. 17055; Leroy J. Morningstar, 2 Speyer Rd., Middletown, Pa. 17057

[21] Appl. No.: 616,036

[22] Filed: Nov. 20, 1990

[51] Int. Cl.[5] ..... H01R 13/405; H01R 13/41

[52] U.S. Cl. ..... 29/883; 439/733; 439/885

[58] Field of Search ..... 439/885, 736, 497, 733; 29/858, 883, 884; 264/272.11

[56] References Cited

U.S. PATENT DOCUMENTS

| | | | |
|---|---|---|---|
| 3,775,552 | 11/1973 | Schumacher | 174/105 R |
| 4,090,293 | 5/1978 | van der Donk | 439/736 |
| 4,231,628 | 11/1980 | Hughes et al. | 29/884 |
| 4,442,594 | 4/1984 | Narozny | 29/884 |
| 4,593,463 | 6/1986 | Kamono et al. | 439/885 |
| 4,875,877 | 10/1989 | Fleak et al. | 439/497 |

*Primary Examiner*—Neil Abrams

[57] ABSTRACT

A connector assembly comprising: electrical contacts (9) spaces apart on an insulative housing block (16), the contacts (9) being interconnected externally of the housing block (16) by webs (7), and the webs (7) being constructed for removal after assembly of the housing block (16) and the electrical contacts (9) to provide fins (27). The fins are to be used to retain the contacts (9) within cavities (40) of a housing (39).

4 Claims, 5 Drawing Sheets

CONNECTOR ASSEMBLY AND CONTACTS WITH SEVERED WEBS

FIELD OF THE INVENTION

The invention relates to a connector assembly for connection to conductive wires to form a cable assembly.

BACKGROUND OF THE INVENTION

A connector assembly disclosed in U.S. Pat. No. 4,875,877 comprises, a conductive ground bus, for connection to ground wires of at least one electrical cable, and conductive signal contacts for connection to signal wires of a least one electrical cable, the signal contacts being joined to the ground bus, an insulative housing block applied over the contacts, at least a selected one of the contacts being detached from the ground bus, and at least one of the signal contacts remaining joined to the ground bus. The connector assembly is constructed for ease of manufacture. For example, the contacts and the ground bus are joined together in a lead frame to eliminate separate parts. The housing block advantageously holds the contacts in desired positions when the contacts are connected to the wires. The contacts are held on pitch spacings that correspond to the pitch spacings of contact receiving cavities of an insulative housing. The contacts are assembled into the cavities of the housing as a group, rather than as individual contacts.

The contacts on the lead frame, being fabricated of thin metal, are easily deflected to misaligned positions. A concern exits that the contacts will be held by a housing block in these misaligned positions. For example, a housing can be applied over the contacts by injection molding fluent plastic material over portions of the contacts. The solidified plastic material is relied on to hold the contacts in their positions. If the contacts are misaligned while the housing is applied, the contacts will be held by the housing in misaligned positions.

U.S. Pat. No. 4,442,594 discloses a support member for holding ends of contacts while removing material from the middle of a strip of contacts to form electrically independent contacts.

SUMMARY OF THE INVENTION

The invention results from a need to maintain the contacts in desired alignment during application of the housing block to the contacts. The contacts are connected together with unitary webs that hold the contacts in desired alignment while the housing block is applied, for example by injection molding. After the housing block is applied, the housing block holds the contacts on desired pitch spacings. The webs are external to the housing block, and continue to hold the contacts in desired alignment. Then the webs are removed, leaving the contacts separated from one another, and leaving tapered fins on the contacts. The fins are used for guiding the contacts into precisely oriented positions within cavities of an insulative housing.

For an understanding of the invention, reference will now be made by way of example to a following detailed description and accompanying drawings.

DETAILED DESCRIPTION

Figure 9:
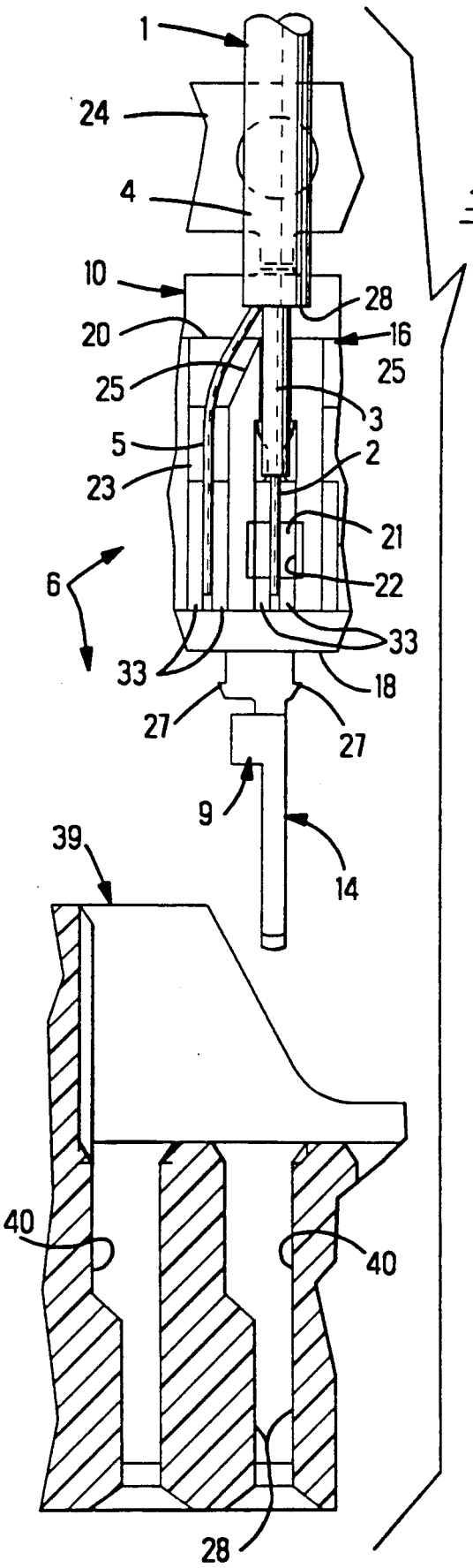
FIG. 9 is a fragmentary section view of the connector assembly of FIG. 3 connected with an electrical cable and an insulative housing receiving the connector assembly of FIG. 3, with parts shown apart from one another.
Figure 10:
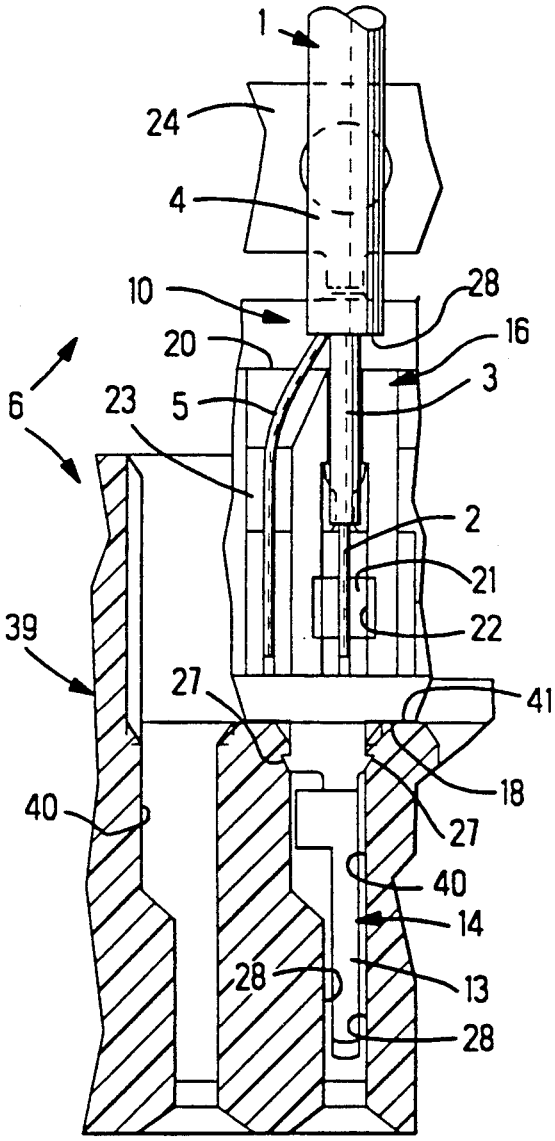
FIG. 10 is a view similar to FIG. 9 illustrating the parts assembled together.

With reference to FIGS. 9 and 10, an electrical cable 1 is constructed with an elongated signal wire 2 or center conductor concentrically encircled by a dielectric 3, in turn encircled by a flexible insulative outer jacket 4 or sheath. A corresponding, elongated and conductive ground wire 5 or drain wire extends along the exterior of the dielectric 3 and is within the jacket 4. The cable 1 may include a single ground wire 5, as shown, or may include first and second ground wires 5, not shown, to provide a combination of a signal wire 2 between two ground wires 5. The invention applies to either cable construction, or to any other cable construction, not shown. The cable construction is cut to expose and to project the signal wire 2, the dielectric 3 and the corresponding ground wire 5 from the jacket 4. An electrical connector assembly 6, FIG. 10, is to be connected to one or multiple cables 1 in a manner described below with reference to FIGS. 1 through 8.

Figure 1:
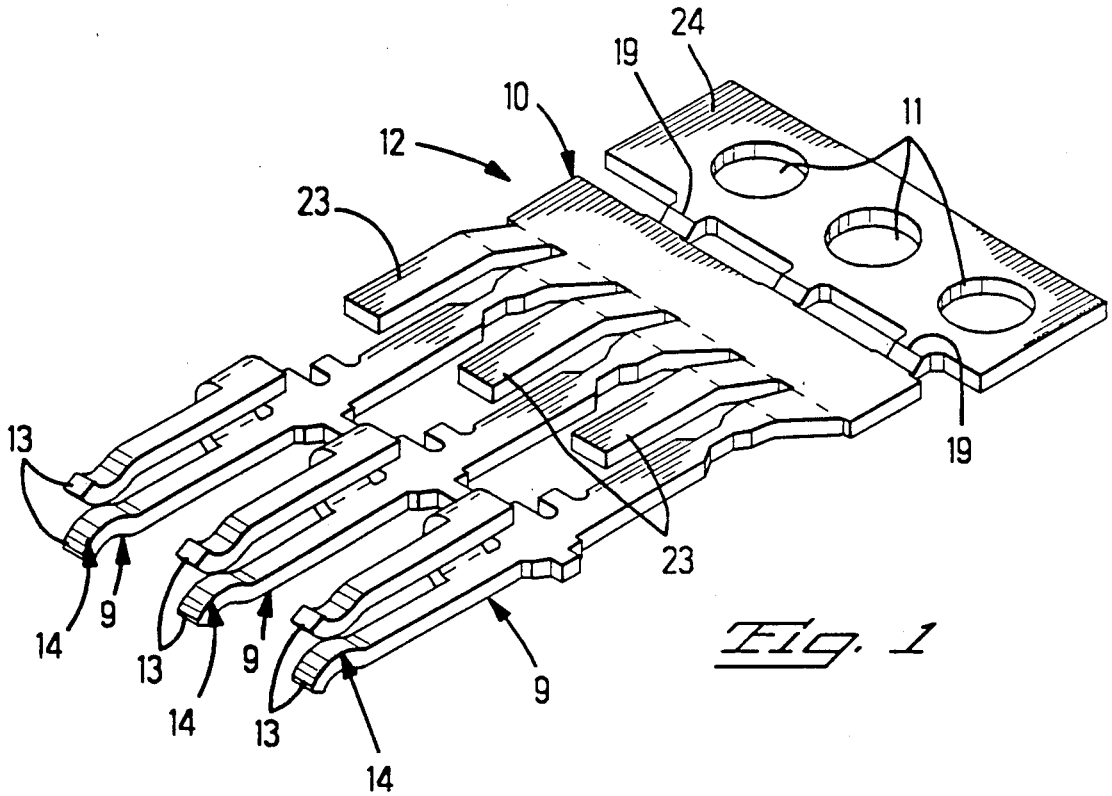
FIG. 1 is a fragmentary perspective view of a lead frame of a connector assembly.
Figure 2:
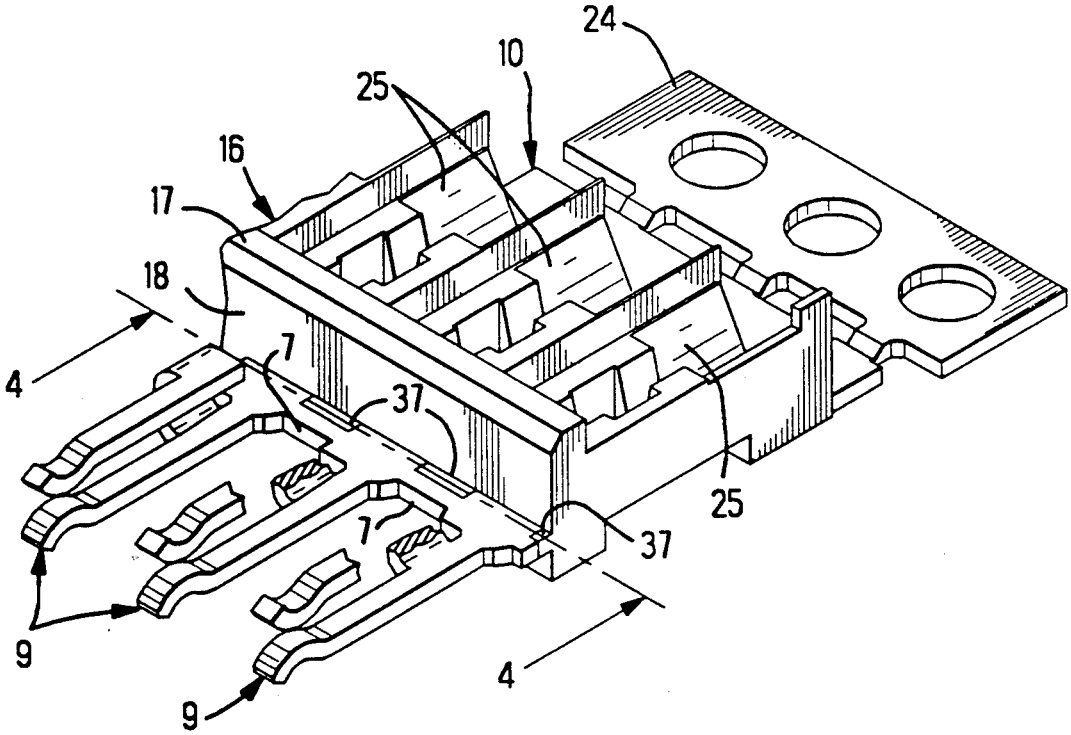
FIG. 2 is a perspective view of an insulative housing block and a lead frame of a connector assembly.

Construction of the connector assembly 6 begins with a series of elongated electrical contacts 9, FIG. 1, in a row. The contacts 9 project forwardly from an elongated ground bus 10. A series of pilot holes 11 extend through the ground bus 10. The contacts 9 when joined to the ground bus 10 provide a lead frame 12, known as an array of conductive paths for conducting electricity, with the paths joined together and cut out from a strip of metal. Each of the contacts 9 includes a pair of spaced apart fingers 13 defining an electrical receptacle 14 at a front end. The fingers 13 are cut out from the strip of metal while the metal is in a flat plane. The fingers 13 of each of the contacts 9 are formed by bending, such that the fingers 13 are pivoted out of the plane of the metal to oppose each other and to define therebetween the receptacle 14. The contacts 9 are on pitch spacings, that are the repeated spacings between longitudinal axes of the multiple contacts 9 in a row. Webs 7 of the metal strip bridge between adjacent contacts 9.

With reference to FIGS. 2, 5, 6 and 7, a housing block 16 is applied to each contact 9. For example, the housing block 16 is formed by injection molding a fluent plastics material that embeds the contacts 9. A front end 17 of the housing block is formed with a front wall 18 extending transverse to the row of contacts 9. The housing block 16 extends to a rear wall 20 from which the ground bus 10 projects. Wire connecting portions 21 of the contacts 9 appear at corresponding spaced apart, openings 22 formed by molding the housing block 16. Wire connecting portions 23, FIGS. 9 and 10, of the ground bus 10 extend from the ground bus 10. Removable portions 19 of the ground bus 10 attach to a carrier strip 24 having the pilot holes 11. The housing block 16 holds all the contacts 9 on a desired pitch spacing.

Wire receiving channels 25, FIGS. 2, 5, 9 and 10, formed by molding the housing block 16, extend from the rear wall 20 and forwardly and axially of corresponding contacts 9 and corresponding wire connecting portions 23. An end 28, FIGS. 9 and 10, of the jacket 4 of a corresponding cable 1 opposes the rear wall 20. The signal wire 2 of the cable 1 and each corresponding ground wire 5 of the cable 1 extend along corresponding channels 25. The signal wire 2 extends along the channel 25 to the wire connecting portion 21 of a corresponding contact 9. Each corresponding ground wire 5 extends along a corresponding channel 25 to the wire connecting portion 23.

Further details of construction of the housing block 16 are described in U.S. Pat. No. 4,875,877, according to which, wire gripping portions 33, FIGS. 9 and 10, of the housing block 16 are provided for gripping and positioning the wires 2 and 5 along corresponding wire connecting portions 21 and 23, and further according to which, the connection between a corresponding wire 2 or 5 and a corresponding wire connecting portion 21 or 23 is accomplished by a welding operation or a soldering operation. Each contact 9 that is connected to a signal wire 2 is designated a signal contact. Each contact 9 that remains connected to the ground bus 10 is designated a ground contact. Each contact 9 is joined to the lead frame 12 by a removable portion of the lead frame 12. Removal of a removable portion from a corresponding contact 9, as further described in U.S. Pat. No. 4,875,877, will designate that contact 9 as a signal contact. Each contact 9 that remains joined to the ground bus 10 is designated a ground contact 9.

Figure 4:
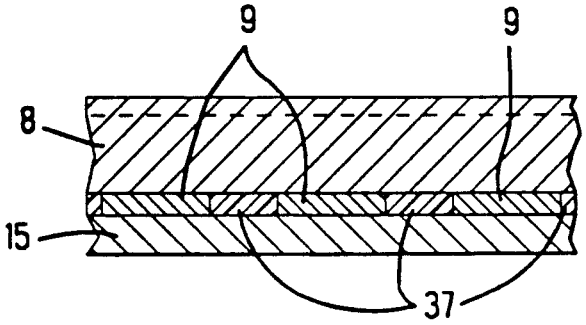
FIG. 4 is a section view taken along the line 4-4 of FIG. 2.
Figure 6:
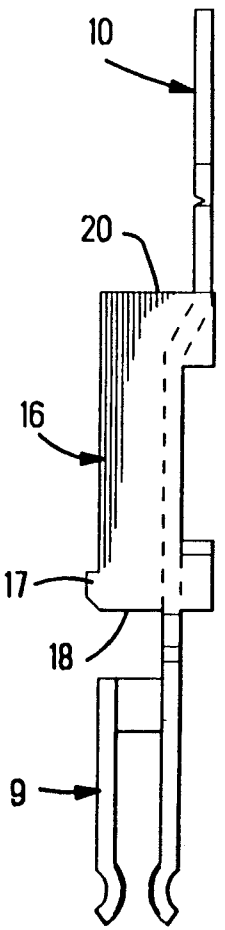
FIG. 6 is a side view of the structure shown in FIG. 5.
Figure 5:
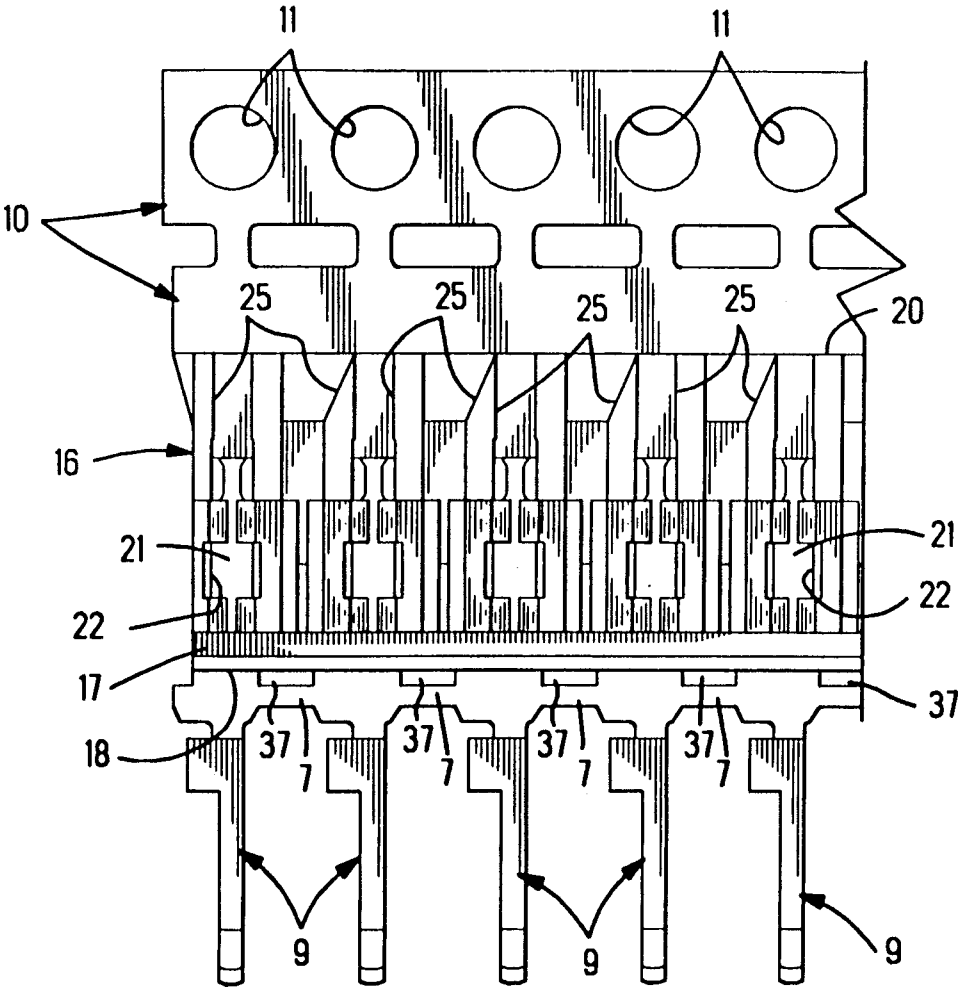
FIG. 5 is a top plan view of the structure shown in FIG. 2.
Figure 8:
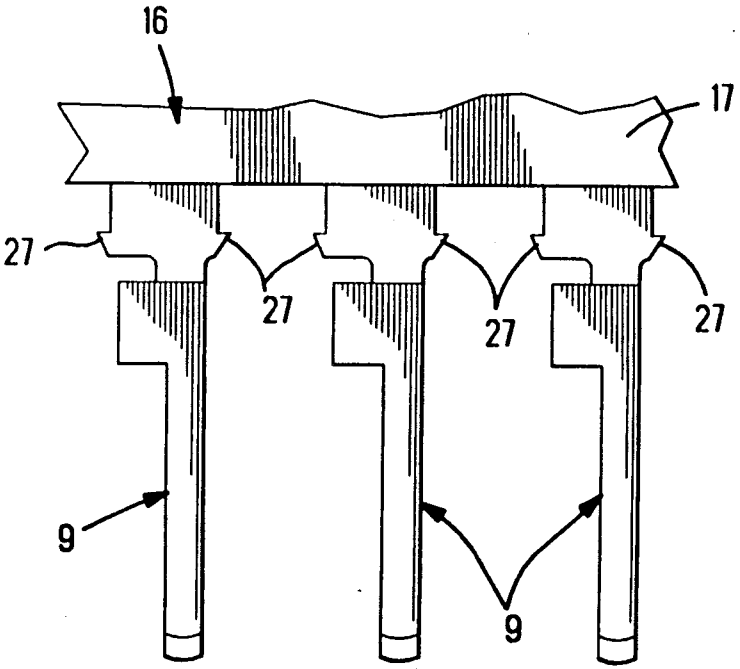
FIG. 8 is a top plan view of a portion of the structure shown in FIG. 3.
Figure 7:
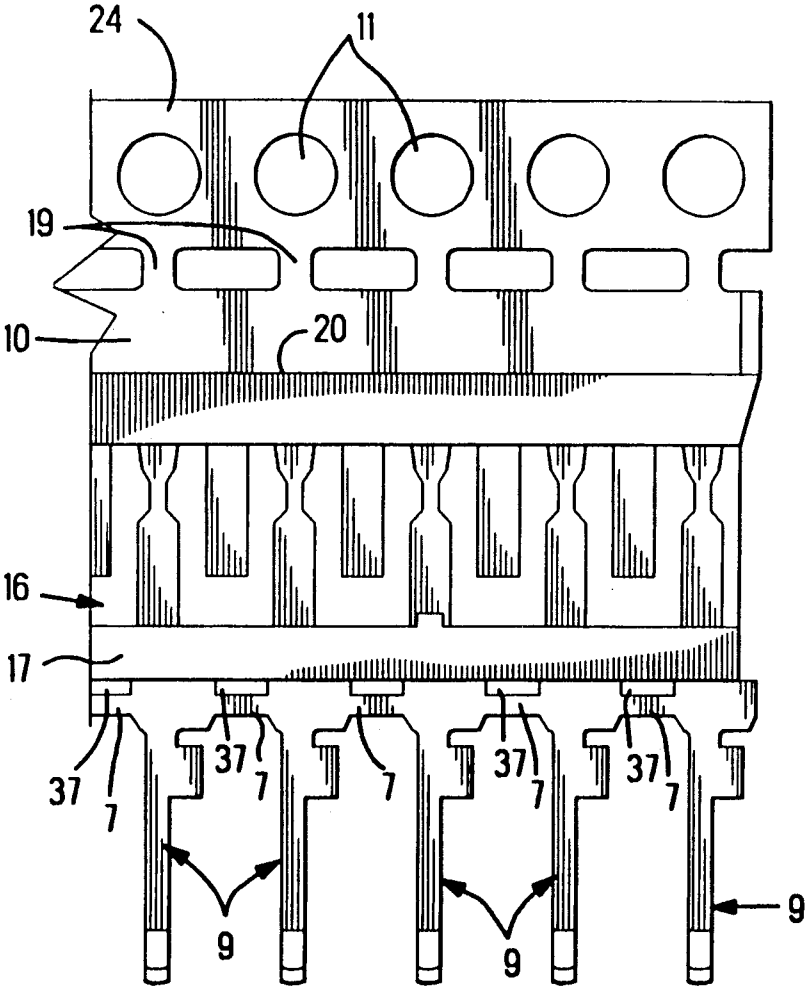
FIG. 7 is a bottom view of the structure shown in FIG. 5.

With reference to FIG. 4, the coplanar contacts 9 are held in precise alignment when the insulative material of the housing block 16 is applied. For example, the insulative material is applied by an injection molding process, with mold dies 8 and 15 of a molding apparatus holding the contacts 9 in between the dies 8 and 15 while the insulative material is injected into die cavities to form the housing block 10. The metal thickness of the contacts 9 is clamped between the molding dies and is held stationary. The metal thickness, where clamped, blocks the flow of fluent insulative material. In this manner, the insulative material is blocked from covering over the wire connecting portions of the contacts 9 and the portions of the contacts 9 that project from the front and from the rear of the housing block 10. The solidified housing block 10 holds the contacts 9 in desired positions, including desired pitch spacings, after ejection from the molding dies 8 and 15. Additional segments of fluent insulative material 37, FIGS. 2 and 4, will flow into and will fill a corresponding space between adjacent contacts 9 and between the front end 17 and a corresponding web 7. The thickness of the segments of material 37 will fill a space between the dies 8 and 15, and is limited to the thickness of the contacts 9.

Figure 3:
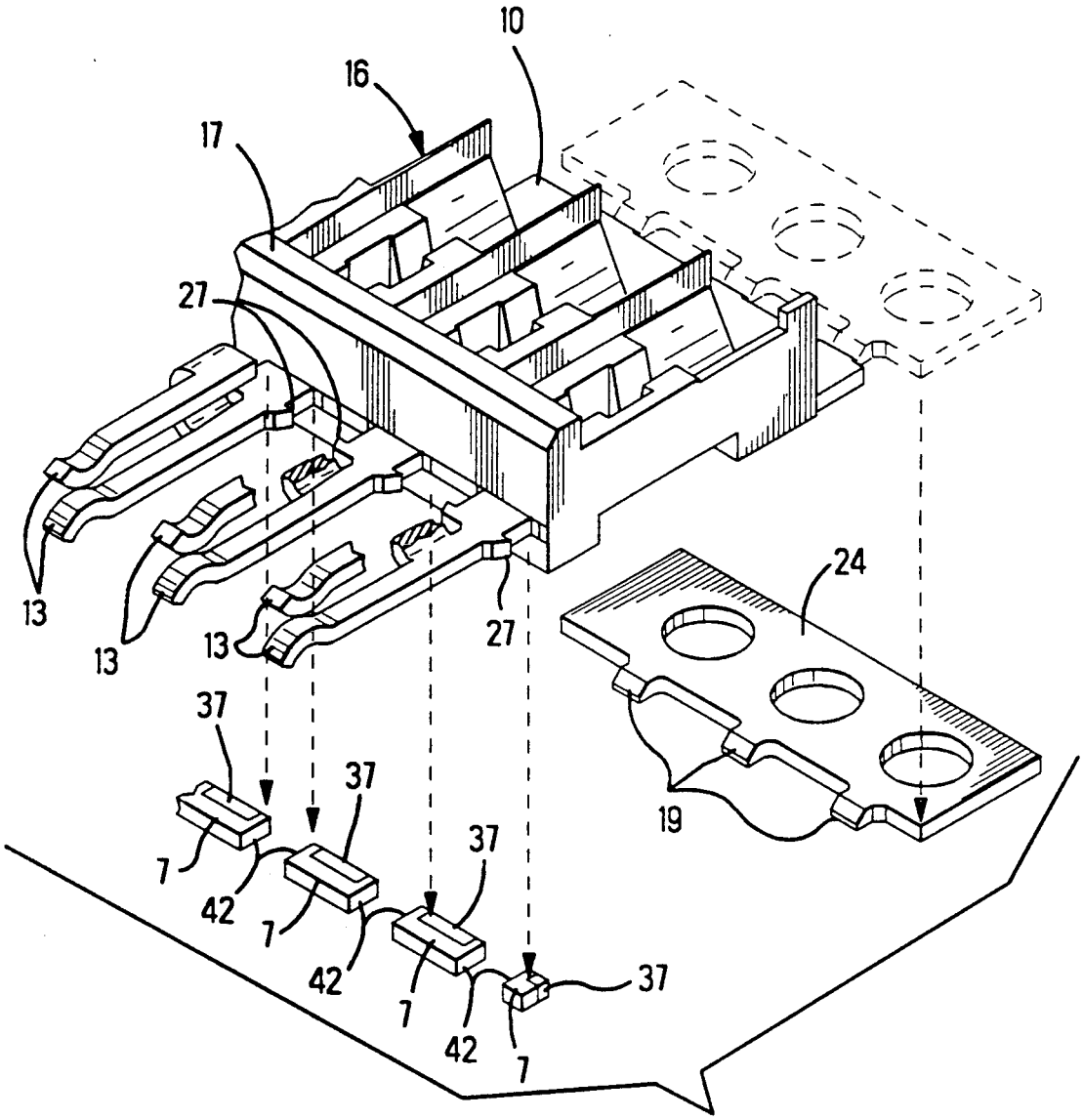
FIG. 3 is a view similar to FIG. 2 illustrating removal of portions of the lead frame and insulative material shown in FIG. 2.

Reference will now be made to FIG. 3. After solidification of the segments of material 37 and the housing block 16, and following ejection from the dies 8 and 15, the lead frame 12 is subjected to a stamping operation to sever and remove the segments of material 37 and to form fins 27 by severing and removing the webs 7 and side portions 42 of the contacts 9. The contacts 9 have corresponding fins 27 which project in the plane of the metal thickness laterally of the longitudinal axes of the contacts 9. The carrier strip 24 can be removed by severing the removable portions 19, or the carrier strip 24 can remain during connection of the wires 2 and 5 as shown in FIGS. 9 and 10.

A feature of the invention will now be described with reference to FIGS. 9 and 10. The contacts 9 project forward of the housing block 16 for assembly with an insulative housing 39. The housing 39 includes multiple contact receiving cavities 40 in a row and spaced apart on pitch spacings corresponding to that of the series of contacts 9. A representative contact 9 is shown fully assembled in a corresponding, representative cavity 40 in a representative row, FIG. 10, with the front 18 of the housing block 10 engaging a rear 41 of the housing 39. The fins 27 engage opposite interior walls of the cavity to hold the contact 9 in stable position, and to lock the contact 9 and the housing 39. The fins 27 hold the contacts 9 in the cavities 40 against undesired movement. Clearances 28 between the interior walls of the cavity 40 and the contact 9 allow the fingers 13 to move apart in response to insertion of a conductive terminal post, not shown, into the receptacle 14.

We claim:

1. A method for assembling an electrical connector assembly, comprising the steps of:

applying an insulative housing block to electrical contacts connected by integral webs extending in the thickness of said contacts, separating said contacts from one another by removing the webs and leaving fins projecting from said contacts within the thickness of respective said contacts, connecting said contacts to wires of at least one electrical cable, inserting said contacts and the fins into corresponding cavities of an insulative housing, and holding the contacts in stable positions by engaging interior walls of the cavities by the fins.

2. A method as recited in claim 1, and further including the steps of:

clamping the thickness of said contacts between mold dies, and molding fluent insulative material in the mold dies and in spaces between corresponding said contacts and between an end of said housing block and said webs, and removing the webs to separate the contacts from one another.

3. A method as recited in claim 2, and further including the step of: removing insulative material in said spaces.

4. A method as recited in claim 2, and further including the step of: removing said webs and said insulative material in said spaces by stamping.

* * * * *